US010259032B2

(12) United States Patent
Ikeuchi et al.

(10) Patent No.: US 10,259,032 B2
(45) Date of Patent: Apr. 16, 2019

(54) CUTTING DEVICE FOR METAL FOIL

(71) Applicant: NISSAN MOTOR CO., LTD., Yokohama-Shi, Kanagawa (JP)

(72) Inventors: Jun Ikeuchi, Kanagawa (JP); Kazuhiro Mitamura, Kanagawa (JP); Masaki Saito, Kanagawa (JP); Motoo Shimizu, Kanagawa (JP); Takeshi Iwata, Kanagawa (JP); Kuniyoshi Wakamatsu, Kanagawa (JP); Toshiaki Ohrui, Kanagawa (JP); Tomoya Baba, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 63 days.

(21) Appl. No.: 15/023,714

(22) PCT Filed: Jul. 17, 2014

(86) PCT No.: PCT/JP2014/068993
§ 371 (c)(1),
(2) Date: Mar. 22, 2016

(87) PCT Pub. No.: WO2015/045580
PCT Pub. Date: Apr. 2, 2015

(65) Prior Publication Data

US 2016/0214266 A1 Jul. 28, 2016

(30) Foreign Application Priority Data

Sep. 30, 2013 (JP) ..... 2013-202867

(51) Int. Cl.

| | |
|---|---|
| ***B21D 28/16*** | (2006.01) |
| ***B21D 28/18*** | (2006.01) |
| ***B26D 1/06*** | (2006.01) |
| ***B26D 7/01*** | (2006.01) |
| ***B26D 7/02*** | (2006.01) |

(Continued)

(52) U.S. Cl.
CPC ..... *B21D 28/16* (2013.01); *B21D 28/18* (2013.01); *B21D 35/007* (2013.01); *B26D 1/065* (2013.01);

(Continued)

(58) Field of Classification Search
CPC ..... B23K 26/53; B21D 28/16; B21D 28/18; Y10T 83/943; Y10T 83/9447;

(Continued)

(56) References Cited

U.S. PATENT DOCUMENTS 4,002,092 A * 1/1977 Smith ..... B23B 51/0406 83/55
5,458,717 A * 10/1995 Kurita ..... B21D 28/16 156/250

(Continued)

FOREIGN PATENT DOCUMENTS

CN 101954800 A 1/2011
DE 102012011767 A1 * 11/2013

(Continued)

*Primary Examiner* — Jennifer B Swinney
(74) *Attorney, Agent, or Firm* — Young Basile Hanlon & MacFarlane, P.C.

(57) ABSTRACT

Metal foil base material placed on lower blade is first restricted under pressure by lower blade and pad and then cut by a shearing action based on an engagement of lower blade side cutting edge and upper blade side cutting edge. Resin face sheets are fixed to the top surface of lower blade and the pressing surface of pad, the face sheets having a larger friction coefficient than that of these surfaces. By frictional forces imparted by face sheets, metal foil base material is prevented from being dragged and moved by the pressing force of the upper blade prior to cutting. Consequently, the occurrence of "burr", "roll-up", and so forth is eliminated thereby ensuring a good cutting quality.

8 Claims, 3 Drawing Sheets

(51) Int. Cl.
*B21D 35/00* (2006.01)
*B26D 1/00* (2006.01)

(52) U.S. Cl.
CPC ..... *B26D 7/015* (2013.01); *B26D 7/025* (2013.01); *B26D 1/0006* (2013.01); *B26D 7/02* (2013.01); *B26D 2001/0066* (2013.01)

(58) Field of Classification Search
CPC ... Y10T 83/9428; Y10T 83/9444; B26D 1/08; B26D 7/02
See application file for complete search history.

(56) References Cited

U.S. PATENT DOCUMENTS

| | | | | |
|---|---|---|---|---|
| 7,430,951 | B1 * | 10/2008 | Li | B23D 15/08 83/684 |
| 8,911,166 | B2 | 12/2014 | Tsukada | |
| 2003/0029288 | A1 * | 2/2003 | Golovashchenko | B23D 15/04 83/13 |
| 2005/0211032 | A1 * | 9/2005 | Liu | B21D 28/16 83/13 |

FOREIGN PATENT DOCUMENTS

| | | | | |
|---|---|---|---|---|
| EP | 0323673 | A1 * | 7/1989 | B21D 28/18 |
| JP | 57184617 | A * | 11/1982 | |
| JP | 2004058180 | A | 2/2004 | |
| JP | 2007152436 | A | 6/2007 | |
| JP | 2007216293 | A * | 8/2007 | B21D 28/16 |
| JP | 2007237324 | A | 9/2007 | |

* cited by examiner

FIG.5
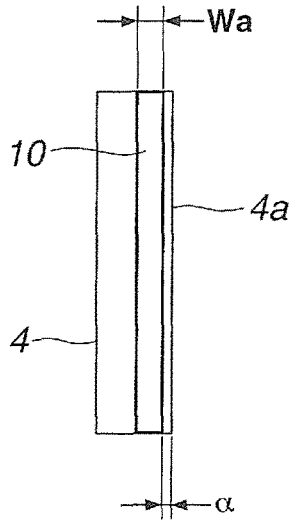
FIG.6
| | THICKNESS OF LOWER BLADE SIDE FACE SHEET (μm) | | | | |
|---|---|---|---|---|---|
| | 0 μm | 50 μm | 100 μm | 150 μm | 200 μm |
| SHEARED PLANE RATIO (%) | 76 % | 97 % | 100 % | 82 % | 71 % |
FIG.7
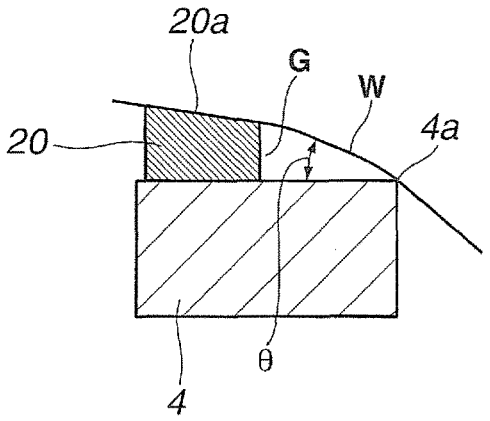

CUTTING DEVICE FOR METAL FOIL

CROSS REFERENCE TO RELATED APPLICATION

The present application claims priority to Japanese Patent Application No. 2013-202867, filed Sep. 30, 2013, incorporated herein in its entirety.

TECHNICAL FIELD

The present invention relates to a cutting device for metal foil as represented by aluminum foil, copper foil and the like.

BACKGROUND

As this kind of metal foil cutting device, an example as discussed in Japanese Patent Application Publication No. 2007-152436 has been proposed. A cutting device as discussed in Japanese Patent Application Publication No. 2007-152436 is provided for the purpose of cutting metal foil for use in a capacitor such as aluminum, tantalum, niobium, titanium and zirconium by a shearing action caused by an engagement between a first blade and a second blade, in which both of the blades are adapted to have a depth of engagement (or a lap margin) and a clearance therebetween within a specified numerical value range.

However, the cutting device discussed in Japanese Patent Application Publication No. 2007-152436 is provided based on a shearing action caused by an engagement between the first and second blades and therefore it cannot avoid the occurrence of a phenomenon where metal foil is pulled toward the side of an engaged portion of both of the blades. The trend becomes noticeable as the thickness dimension of a metal foil to be cut increases; this is because the depth of engagement and a clearance between the blades are inevitably increased according to the increase of the thickness dimension of metal foil. As a result, the metal foil is moved thereby possibly causing the deterioration of cutting quality and the occurrence of "burr" and "roll-up" on the cut surface.

SUMMARY

The present invention has been made in view of such problems, for the purpose of providing a cutting device able to restrain metal foil from being dragged and moved at the time of cutting while basically performing cutting under a shearing action caused by the engagement of both blades.

The present invention is adapted to cut metal foil placed on a lower blade by a shearing action based on an engagement of a lower blade and an upper blade, in which a holding device having a larger friction coefficient than that of the lower blade is provided on the lower blade in such a manner as to interpose between the lower blade and metal foil placed thereon.

According to the present invention, a holding device having a larger friction coefficient than that of the lower blade is provided to intervene between the lower blade and metal foil, with which it becomes possible to prevent the metal foil from being dragged and moved at the time of cutting and prevent the occurrence of "burr" and "roll-up" while improving cutting accuracy and cutting quality.

BRIEF DESCRIPTION OF THE DRAWINGS

FIG. 5 is an explanatory plan view of a lower blade as shown in FIG. 4(A);

FIG. 6 is a table showing a relationship between the thickness of a lower blade side face sheet and a sheared plane ratio (%) in the cutting device as shown in FIG. 4; and FIG. 7 is an enlarged view similar to FIG. 4(B) but showing a second embodiment of a cutting device of the present invention.

DESCRIPTION OF THE EMBODIMENTS

Figure 1:
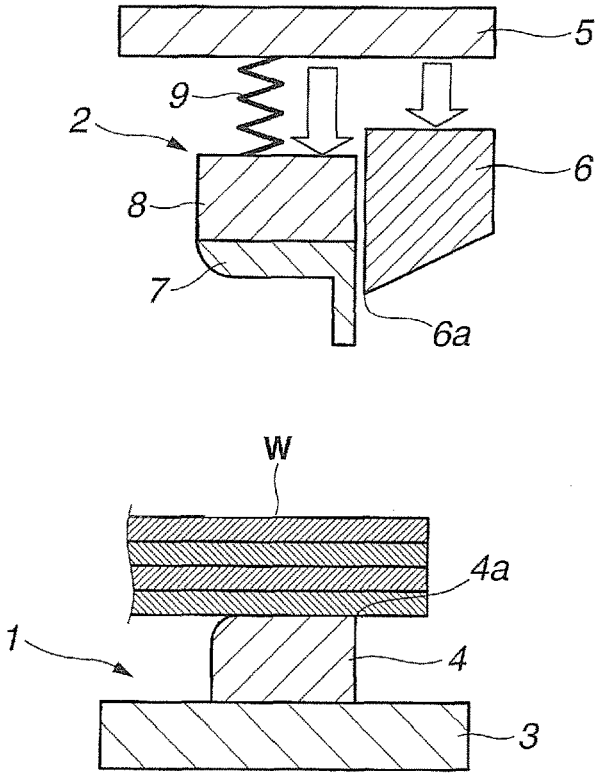
FIG. 1 is an explanatory sectional view of a first embodiment of a cutting device according to the present invention, showing a state where an upper die is moved upward.
Figure 2:
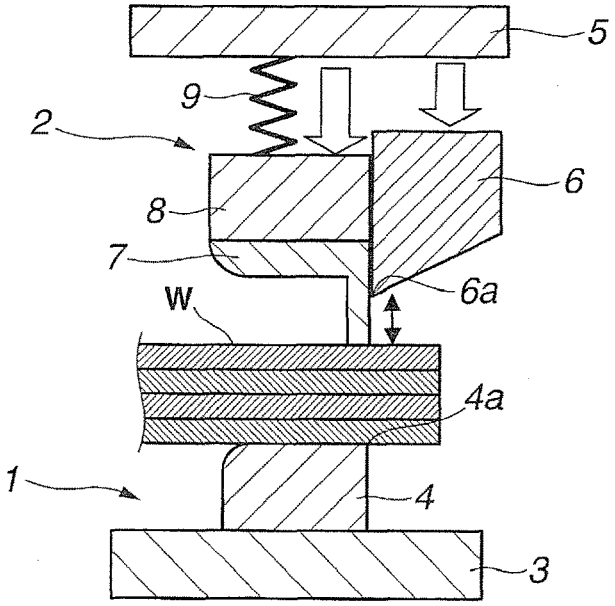
FIG. 2 is an explanatory sectional view showing a state where the upper die is lowered from the state of FIG. 1 to bring a pad into contact with a metal foil base material.
Figure 3:
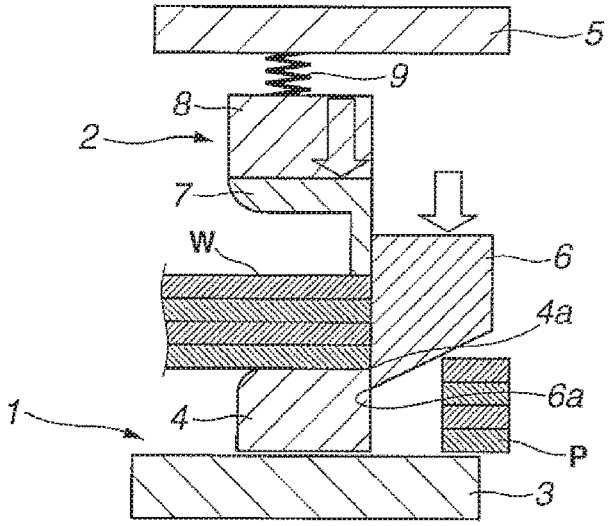
FIG. 3 is an explanatory sectional view showing a state after the upper die is further lowered from the state of FIG. 2 so that the metal foil base material is cut.

FIGS. 1 to 6 are provided showing a first embodiment of a metal foil cutting device according to the present invention. In particular, FIGS. 1 to 3 show a basic structure of a cutting device of a press type, and operations made under the structure. FIGS. 4 and 5 specifically shows an essential part of the cutting device.

As shown in FIG. 1, a cutting device is composed of lower die 1 and upper die 2 vertically movably disposed opposite to lower die 1.

Lower die 1 is provided including lower holder 3, and lower blade 4 fixed onto lower holder 3 and formed of steel, a super hard metal or the like. Lower blade 4 has a corner part formed between its front-side vertical wall and top surface, the corner part serving as cutting edge 4*a* of the lower blade 4 side. An object to be cut, i.e., a long lengths of metal foil base material (for example, a long lengths of multilayered metal foil base material W) is to be supplied and placed onto lower blade 4.

On the other hand, upper die 2 is provided having upper holder 5 as a main body, with which upper blade 6 formed of steel, a super hard metal or the like and pad 7 serving as a pressing member formed of steel or the like are combined. Pad 7 is secured to pad holder 8. Upper blade 6 has a corner part at its lower end portion and on the side closer to pad 7, the corner part serving as cutting edge 6*a*. Additionally, upper blade 6 is supported to be vertically movable with respect to upper holder 5, while pad holder 8 is vertically movably and elastically supported by upper holder 5 through elastic member 9 such as urethane and compression coil spring. In the state where pad 7 is brought up to the uppermost position as shown in FIG. 1, the lower end portion of pad 7 is disposed lower than upper blade 6.

In the thus constructed cutting device, when the long lengths of multilayered metal foil base material W is conveyed from the left of FIG. 1 at a given rate and then metal foil base material W having been conveyed to some extent is stopped and positioned on lower blade 4, upper die 2 including upper holder 5 as the main body is moved down toward lower die 1 as a whole. According to the downward movement of upper die 2, pad 7 is firstly brought into contact with metal foil base material W placed on lower blade 4 as shown in FIG. 2, and then compresses elastic member 9, with which elastic force pad 7 begins to press metal foil base material W against lower blade 4. With this, the vicinity of a section of metal foil base material W which is to serve as a cutting line (i.e., a section where cutting edge 4*a* of the lower blade 4 side and cutting edge 6*a* of the upper blade 6 side are engaged) is restricted under pressure by lower blade 4 and pad 7.

Even if upper die 2 is further lowered, pad 7 is kept being pressed against metal foil base material W and therefore only upper holder 5 and upper blade 6 are moved downward, so that cutting edge 4*a* of the lower blade 4 side and cutting edge 6*a* of the upper blade 6 side comes to engage with each other. By receiving a shearing action based on the engagement between cutting edge 4*a* of the lower blade 4 side and cutting edge 6*a* of the upper blade 6 side, metal foil piece P having a certain size is to be cut out of metal foil base material W as shown in FIG. 3.

When upper die 2 is moved upward after cutting, firstly upper blade 6 moves upward and then pad 7 moves upward to go away from metal foil base material W. Thus the whole of upper die 2 including upper blade 6 and pad 7 is reset to the initial state as shown in FIG. 1 thereby completing one cycle. From then on, the above-mentioned operations are repeated.

Figure 4A:
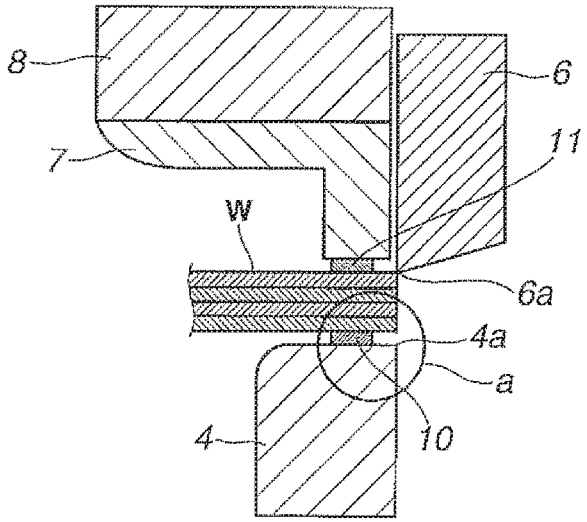
FIG. 4(A) is an enlarged view of an essential part of the cutting device as shown in FIGS. 1 to 3.
Figure 4B:
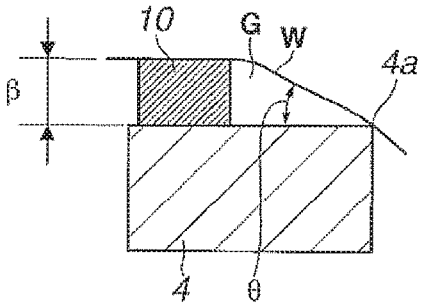
FIG. 4(B) is a further enlarged view of a part "a" as shown in FIG. 4(A)

FIG. 4(A) and FIG. 4(B) specifically illustrate an essential part of the cutting device as shown in FIGS. 1 to 3. In order to prevent metal foil base material W from being dragged and moved at the time of cutting as soon as possible, face sheets 10 and 11 having a prescribed thickness are fixedly attached as holding devices to sections of lower blade 4 and pad 7 directly brought into contact with metal foil base material W (which sections are also referred to as the top surface of lower blade 4 and a pressing surface or bottom surface of pad 7), respectively, with an acrylic adhesive or the like.

With the above arrangement, when restraining lower blade 4 and metal foil base material W under pressure as shown in FIG. 4(A), face sheets 10, 11 are adapted to intervene between the top surface of lower blade 4 and metal foil base material W and between the pressing surface of pad 7 and metal foil base material W, respectively. It is apparent from this that face sheets 10, 11 disposed respectively on the lower blade 4 side and the pad 7 side are omitted from FIGS. 1 to 3 and that these figures illustrate only the basic structure of the cutting device and its basic operations.

Face sheets 10, 11 are conditioned to have a friction coefficient larger than that of metal that forms lower blade 4 and pad 7. In the present embodiment, a resin sheet having a larger friction coefficient than that of metal and formed of polypropylene (PP) or polyethylene (PE) is adopted as face sheets 10, 11. For example, in the case of regarding face sheet 10 of the lower blade 4 side, it has a width dimension Wa of about 2 mm as shown in FIG. 5, and fixedly attached at a location having a certain distance $\alpha$ (for example, about 0.5 mm) from cutting edge 4*a* in order to prevent itself from getting caught up toward the cutting edge 4*a* side. Such a relationship is also applied to face sheet 11 of the pad 7 side, and more specifically, face sheet 11 of the pad 7 side is fixedly attached at a location having a certain distance $\alpha$ (for example, 0.5 mm or more) from cutting edge 6*a* of the upper blade 6 side as shown in FIG. 4(A).

Additionally, as apparent from FIG. 4(B) further enlarging the part "a" of FIG. 4(A), metal foil base material W before cutting is in direct contact with face sheet 10 of the lower blade 4 side having a certain thickness $\beta$ so to be supported thereby, regardless of whether it is restrained under pressure by pad 7; therefore, metal foil base material W droops toward cutting edge 4*a* disposed lower than face sheet 10 while lying over face sheet 10 and cutting edge 4*a* thereby taking the form of the so-called "droop". As a result, there is defined a certain extent of gap G (or a region enclosed with the top surface of lower blade 4, face sheet 10 and metal foil base material W) at a location immediately close to cutting edge 4*a* of the lower blade 4 side.

Hence, when metal foil base material W is cut under a searing action based on the engagement between cutting edge 4*a* of the lower blade 4 side and cutting edge 6*a* of the upper blade 6 side in the state where metal foil base material W is restricted under pressure by face sheet 10 of the lower blade 4 side and face sheet 11 of the pad 7 side, a section of metal foil base material W overhanging from the upper blade 4 side toward the upper blade 6 side is to be depressed by upper blade 6. Due to the depressing force of upper blade 6, even a section restricted under pressure between upper and lower face sheets 10, 11 tends to be dragged and moved in advance of cutting.

However, the upper and lower face sheets 10, 11 have so large friction coefficient as to generate a great frictional force against metal foil base material W, thereby resisting the action of metal foil base material W inclinable to be dragged by the above-mentioned depressing force of upper blade 6. With this, it becomes possible to ease the action of metal foil base material W inclinable to be dragged in the depression direction by upper blade 6. As a result, metal foil base material W and metal foil piece P cut out thereof can obtain a good cutting quality at their cut surfaces and the cut surfaces are prevented from the occurrence of "burr" and "roll-up", thereby contributing to the improvement of the cutting quality.

Since lower blade 4 and pad 7 are provided with face sheets 10, 11 at positions opposite to each other, metal foil base material W before cutting can surely be restricted under pressure while absorbing unevenness on the top surface of lower blade 4 and the pressing surface of pad 7, defective parallelism between these surfaces etc, so that the action of metal foil base material W inclinable to be dragged in the depression direction by upper blade 6 can more excellently be suppressed.

Moreover, the upper and lower face sheets 10, 11 are disposed at a location distant from cutting edge 4*a* of the lower blade 4 side and from cutting edge 6*a* of the upper blade 6 side, respectively, as shown in FIGS. 4 and 5, with which gap G is defined at a region enclosed with lower blade 4, face sheet 10 and metal foil base material W. Consequently, face sheets 10, 11 neither interfere with cutting edges 4*a*, 6*a* nor involved in the engaged portion formed between both cutting edges 4*a*, 6*a* at the time of cutting.

FIG. 6 shows variation in sheared plane ratio (%) or in an index of cutting quality, obtained by changing thickness $\beta$ of face sheet 10 of the lower blade 4 side as shown in FIG. 4 step by step. Incidentally, the sheared plane ratio (%) means a ratio obtained in such a manner as to repeat the cutting of metal foil piece P on a lot of sheets, observe a sheared incised surface of the sheets, and then divide the number of sheets the sheared incised surface of which were smooth sheared plane (or a burnished plane) having no occurrence of "burr" and "roll-up" by the total number of sheets. Furthermore, the case where the thickness $\beta$ of face sheet 10 of the lower blade 4 side was 0 μm as shown in FIG. 6 means a case where face sheet 10 of the lower blade 4 side was not used. As apparent from FIG. 6, it can be confirmed that the sheared plane ratio is reduced when the thickness $\beta$ of face sheet 10 of the lower blade 4 side was 0 μm, 150 μm and 200 μm. Additionally, if the desired sheared plane ratio was set to 90% or greater, it was attained when the thickness $\beta$ of face sheet 10 of the lower blade 4 side attaining the target value was 50 μm and 100 μm.

In view of the above, when the thickness β of face sheet 10 is larger, metal foil base material W which droops from the face sheet 10 side toward the cutting edge 4*a* side while lying over face sheet 10 and cutting edge 4*a* as shown in FIG. 4(B) is made more vertical so as to get closer to a direction parallel with an engaged plane formed between both cutting edges 4*a*, 6*a*. It can be supposed this is why the sheared plane ratio (%) serving as an index of cutting quality reduced.

In other words, if angle θ formed between the top surface of lower blade 4 and metal foil base material W lying over face sheet 10 and cutting edge 4*a* as shown in FIG. 4(B) becomes excessively large, the sheared plane ratio (%) serving as an index of cutting quality is to be reduced.

As has been explained on FIG. 5, face sheet 10 is fixed at a location about 0.5 mm (as a certain distance α) farther than the position of cutting edge 4*a* of the lower blade 4 side in order to prevent face sheet 10 from being involved in the side of cutting edge 4*a* of lower blade 4 and from interfering with cutting edge 4*a*. Therefore, it was confirmed that, if angle θ formed between the top surface of lower blade 4 and metal foil base material W lying over face sheet 10 and cutting edge 4*a* as shown in FIG. 4(B) exceeds 12°, the sheared plane ratio (%) serving as an index of cutting quality falls short of 90%.

On the precondition that face sheet 10 is fixed at a location about 0.5 mm (as a certain distance α) farther than the position of cutting edge 4*a* of the lower blade 4 side, a 90% or greater sheared plane ratio (an index of cutting quality) should be ensured if the thickness β of face sheet 10 of the lower blade 4 side ranges from 50 to 100 μm and if angle θ is not larger than 12°. These conditions are considered to be also applicable to face sheet 11 of the pad 7 side.

FIG. 7 illustrates a second embodiment of a cutting device according to the present invention, in which portions in common with FIG. 4(B) are given the same reference numerals. In the second embodiment face sheet 20 as a holding device on the lower blade 4 side is shaped to have an inclined plane 20*a* descending toward cutting edge 4*a* of the lower blade 4 side.

The second embodiment not only provides the same effect as the above-mentioned first embodiment provides but also brings the advantage of achieving a desired result even if angle θ formed between the top surface of lower blade 4 and metal foil base material W lying over face sheet 10 and cutting edge 4*a* is relatively large.

Although the above embodiments have been described by reference to a case of cutting the multilayered metal foil base material W while keeping its multilayered state, the number of multilayered sheets are not particularly limited as far as the cutting quality is guaranteed. Moreover, a pattern where cutting is conducted on metal foil base material W having only one layer is also acceptable.

The primary function of face sheets 10, 11 serving as holding devices in the above-mentioned embodiments is to generate a relatively great frictional force against metal foil base material W. So long as this requirement is satisfied, face sheets 10, 11 are not necessarily limited to a resin product formed of polypropylene, polyethylene or the like. For example, face sheets 10, 11 may be an elastic product such as rubber. In this case face sheets 10, 11 formed of elastic material is positively subjected to elastic deformation due to the pressing force, thereby bringing the advantage of generating a greater frictional force.

Furthermore, it is also possible to employ an iron-based sheet or a nonferrous metal sheet as face sheets 10, 11, in which case the surfaces thereof may be formed to have a rough shape attaining a desired frictional force, such as a satin shape or an uneven shape. With such a rough shape, it becomes possible to generate a desired frictional force against metal foil base material W.

The invention claimed is:

1. A cutting device for metal foil, comprising:

a lower blade; an upper blade engageable with the lower blade, and a first holding device having a larger friction coefficient than that of the lower blade, the first holding device provided on the lower blade in a manner to interpose between the lower blade and the metal foil placed thereon; and an upper die comprising:

an upper holder;

an upper blade engageable with the lower blade, the upper blade being vertically movable with respect to the upper holder;

a pad holder, the pad holder having a first side facing the upper holder and a second side facing the lower blade, the pad holder elastically supported by the upper holder at the first side;

a pressing member for pressing the metal foil against the lower blade before cutting, the pressing member connected to the pad holder at the second side; and a second holding device provided on the pressing member and having a larger friction coefficient than that of the pressing member, the second holding device interposes between the pressing member and the metal foil to be pressed by the pressing member, wherein the first holding device and the second holding device are disposed vertically opposite to each other, wherein the cutting device is adapted to cut metal foil placed on the lower blade by a shearing action based on the engagement of the lower blade and the upper blade.

2. A cutting device for metal foil, as claimed in claim 1, wherein the first holding device has a predetermined thickness and disposed at a location having a predetermined distance from a cutting edge of the lower blade such that a gap is ensured between the lower blade and the metal foil and at a location immediately close to the cutting edge of the lower blade side.

3. A cutting device for metal foil, as claimed in claim 1, wherein the pressing member being disposed in a predetermined vicinity of the upper blade.

4. A cutting device for metal foil, as claimed in claim 1, wherein the first holding device provided on the lower blade has an inclined plane descending toward a cutting edge of the lower blade.

5. A cutting device for metal foil, as claimed in claim 1, wherein the first holding device is a resin product.

6. A cutting device for metal foil, as claimed in claim 1, wherein the first holding device is an elastic product.

7. A cutting device for metal foil, as claimed in claim 1, wherein the first holding device is a metal product, and a portion of the first holding device contacting the metal foil has a rough surface.

8. A cutting device for metal foil, as claimed in claim 1, wherein the second holding device is a resin product.

* * * * *